US005131942A

United States Patent [19]

Katayama et al.

[11] Patent Number: 5,131,942

[45] Date of Patent: Jul. 21, 1992

[54] METHOD FOR PRODUCING MOLTEN METAL FROM POWDER STATE ORE

[75] Inventors: Hideshi Katayama; Takao Hamada; Shinobu Takeuchi; Takashi Ushijima; Hideyuki Momokawa; Hiroshi Itaya, all of Chiba, Japan

[73] Assignee: Kawasaki Steel Corporation, Japan

[21] Appl. No.: 518,333

[22] Filed: May 4, 1990

Related U.S. Application Data

[63] Continuation of Ser. No. 102,874, Sep. 30, 1987, abandoned.

[30] Foreign Application Priority Data

Jun. 30, 1987 [JP] Japan ..... 62-163730
Sep. 3, 1987 [JP] Japan ..... 62-219044

[51] Int. Cl.[5] ..... C22B 5/14

[52] U.S. Cl. ..... 75/414; 75/445; 75/623

[58] Field of Search ..... 75/414, 445, 623

[56] References Cited

U.S. PATENT DOCUMENTS 3,892,538 7/1975 Seth ..... 75/26
4,317,677 3/1982 Weber et al. ..... 75/43
4,588,437 5/1986 Kepplinger et al. ..... 75/43
4,708,736 11/1987 Hauk et al. ..... 75/26
4,725,308 2/1988 Kepplinger ..... 75/26
4,728,360 3/1988 Hauk et al. ..... 75/26

FOREIGN PATENT DOCUMENTS 114040 7/1984 European Pat. Off. .
176585 10/1984 Japan ..... 266/172
56537 3/1987 Japan .
230907 10/1987 Japan .

*Primary Examiner*—Melvyn J. Andrews
*Attorney, Agent, or Firm*—Austin R. Miller

[57] ABSTRACT

A method and apparatus for producing molten metal from powder state ore through smelting process to be performed in a shaft furnace, utilized the reducing material having grain size greater than that n-times of the gas flow velocity corresponding grain size to charge from the top of a shaft furnace for forming fluidized bed at the upper section of the furnace and a reducing material filled section below the fluidized bed. The method and apparatus for smelting the powder state ore also takes the reducing material having smaller grain size to be blown into the furnace through tuyeres.

15 Claims, 3 Drawing Sheets

METHOD FOR PRODUCING MOLTEN METAL FROM POWDER STATE ORE

This application is a continuation of application Ser. No. 102,874, filed Sept. 30, 1987, now abandoned.

BACKGROUND OF THE INVENTION

1. Field of the Invention

The present invention relates generally to a method and apparatus for producing a molten metal from powder state ore. More specifically, the invention relates to a process for smelting powder state ore by utilizing a shaft furnace.

2. Description of the Background Art

In the recent years, the ratio of powder state ore as a material for producing metal has increased. Especially, according to advances in ore dressing techniques, ratio of the powder state ore is expected to further increase. In this viewpoint, there has been proposed a technique for smelting the powder state ore in a shaft furnace filled with carbon containing reducing material, such as coal or coke.

Smelting process utilizing a shaft furnace has been developed and proposed. In the known process, solid state carbon containing reducing material is charged through the top of the furnace. To the furnace filled with the carbon containing reducing material, oxygen containing gas is blown through tuyeres in order to form a fluidized bed at the upper section of the furnace. Below the fluidized bed, the reduction material filled section is formed. The powder state ore is also blown into the furnace to perform the smelting operation.

By blowing the oxygen containing gas. substantially high temperature race ways are formed around the tuyeres. The powder state ore blown into the furnace through the tuyeres is instantly molten in the race ways. Molten ore flows down through the reducing material filled section or otherwise is fluidized with the reducing material in the fluidized bed. During fluidization, reduction of the ore progresses to refine it. According to the progress of reduction, the density of the molten ore gradually increases. At the same time, the reduced ore undergoes sticking and melting to gradually increase the grain size. The increased grain size of the ore moves down through the reducing material filled section. During downward travel, reduction of the ore is completed. At the same time, the temperature of the ore is increased to the tapping temperature. On the other hand, during the aforementioned reduction process, the ore absorbs metalloids such as Si and Mn. Furthermore, during the reduction process, separation of the metal component and the slag component occurs so that molten metal and slag are separately collected in the bottom of the furnace.

Such a smelting technique is effective for efficiently producing molten metal from the powder state ore. However, the prior proposed technique has a drawback in that the reducing material to be used has to have a grain size large enough so as not to be blown away by the gas flow. The grain size of the reducing material may be variable depending upon the gas flow velocity in the furnace, which varies as flow velocity varies depending upon the temperature in the furnace, pressure, gas flow amount and so forth. The grain size of the reducing material at the borderline between being blown away and not being blown away in relation to the gas flow velocity will be hereafter referred to as "gas flow velocity corresponding grain size". In the practical operation, in consideration of fluctuation of the gas flow velocity, the grain size of the reducing material to be charged in the shaft furnace is selected to be n-times greater than the gas flow velocity corresponding grain size. In such case, reducing material having smaller grain size than the gas flow velocity corresponding grain size will never be used. On the other hand, even when the reducing material which has smaller grain size than the gas flow velocity corresponding grain size, such small grain size reducing material may be easily blown away with the exhausting gas. This apparently increases the cost for producing the molten metal.

On the other hand, temperature and composition of the molten metal are variable depending upon the temperature in the reducing material filled section of the furnace. Therefore, in order to stably produce high quality molten metal, it is essential to control the temperature of the reducing material filled section.

The Japanese Patent First (unexamined) Publication (Tokkai) Showa 62-56537 discloses a method for producing molten metal from powder state ore by forming the fluidized bed of the reducing material and the reducing material filled section in the shaft furnace. However, the disclosed system cannot control the temperature of the reducing material filled section. Therefore, it was not possible to stably perform production of the molten metal and maintain the quality of the produced molten metal at satisfactorily high level.

SUMMARY OF THE INVENTION

Therefore, it is an object of the present invention to provide a method and apparatus for producing molten metal from powder state ore in a shaft furnace, in which solid state carbon containing reducing material can be effectively used for obtaining improved reduction efficiency in view of the consumed reducing material.

Another object of the invention is to provide a method and apparatus for producing molten metal from powder state ore, which can control the temperature of the reducing material filled section in the shaft furnace so as to control the temperature and composition of the molten metal.

In order to accomplish the aforementioned and other objects, the present invention utilizes a reducing material having a grain size greater than the gas flow velocity corresponding grain size to charge from the top of a shaft furnace for forming fluidized bed at the upper section of the furnace and a reducing material filled section below the fluidized bed. The invention also uses a reducing material having a smaller grain size to be blown into the furnace through tuyeres.

In the preferred construction, the shaft furnace may be provided two vertically offset groups of tuyeres. One group of tuyeres are directed to the fluidized bed section formed in the shaft furnace and the other group is directed to the solid state reduction material filled section. The smaller grain size reducing material is separately blown into the fluidized bed section and solid state reducing material filled section, depending upon the grain distribution of the reducing material charged through the top of the furnace.

According to one aspect of the invention, a furnace for producing molten metal from powder state ore comprises a furnace chamber filled with a carbon containing reducing material as a burden, to form a fluidized bed and solid burden layer below the fluidized bed, the burden having a grain size greater than borderline grain size which is determined in relation to gas flow velocity in the furnace, a first tuyere directed to the fluidized bed, a second tuyere directed to the solid burden layer, first means associated with the first tuyere for supplying the latter a mixture of an oxygen containing gas, powder state ore and reducing material dust which has a grain size smaller than the borderline grain size, and second means associated with the second tuyere for supplying the latter a mixture of the oxygen containing gas and the reducing material dust.

A furnace may further comprise a reducing material dust source means for distributing the reducing material dust for the first and second means at respectively controlled distribution rate.

The reducing material dust source means determines the distribution rate of the reducing material dust for the first and second tuyere depending upon a given tapping temperature of the molten metal. The reducing material dust source means determines the distribution rate of the reducing material dust for the first and second tuyeres depending upon a given desired Si concentration of the molten metal to be produced. The reducing material source means increases the distribution rate of the reducing material dust for the second tuyere when the molten metal temperature is lower than the desired tapping temperature and decreases the distribution rate of the reducing material dust for the second tuyere when the molten metal temperature is higher than the desired tapping temperature.

In the alternative, the reducing material dust source means determines the distribution rate of the reducing material dust for the first and second tuyeres depending upon a given desired Si concentration of the molten metal to be produced.

In the preferred embodiment, the borderline grain size is determined relative to a minimum grain size of the burden which is not blown away from the furnace with an exhaust gas. In practice, the borderline grain size is set at a value greater than the minimum grain size. In the alternative, the borderline grain size of the burden is set at 3 mm diameter.

It is preferable and advantageous that the reducing material dust source means is designed for collecting the reducing material dust contained in an exhaust gas of the furnace for recirculating the collected dust through the first and second tuyeres.

According to another aspect of the invention, a method is provided for producing molten metal from powder state ore comprising the steps of:

defining a furnace chamber filled with a carbon containing reducing material as a burden, to form a fluidized bed and a solid a burden layer below the fluidized bed, the burden having a grain size greater than the predetermined borderline grain size which is determined in relation to gas flow velocity in the furnace;

supplying a mixture of an oxygen containing gas, powder state ore and reducing material dust which has grain size smaller than the borderline grain size to a first tuyere directed to the fluidized bed; and supplying a mixture of the oxygen containing gas and the reducing material dust through a second tuyere directed to the solid burden layer.

BRIEF DESCRIPTION OF THE DRAWINGS

The present invention will be understood more fully from the detailed description given herebelow and from the accompanying drawings of the preferred embodiments of the invention, which, however, should not be taken to limit the invention to the specific embodiment of the invention, but are for explanation and understanding only.

In the drawings.

DESCRIPTION OF THE PREFERRED EMBODIMENT

Figure 1:
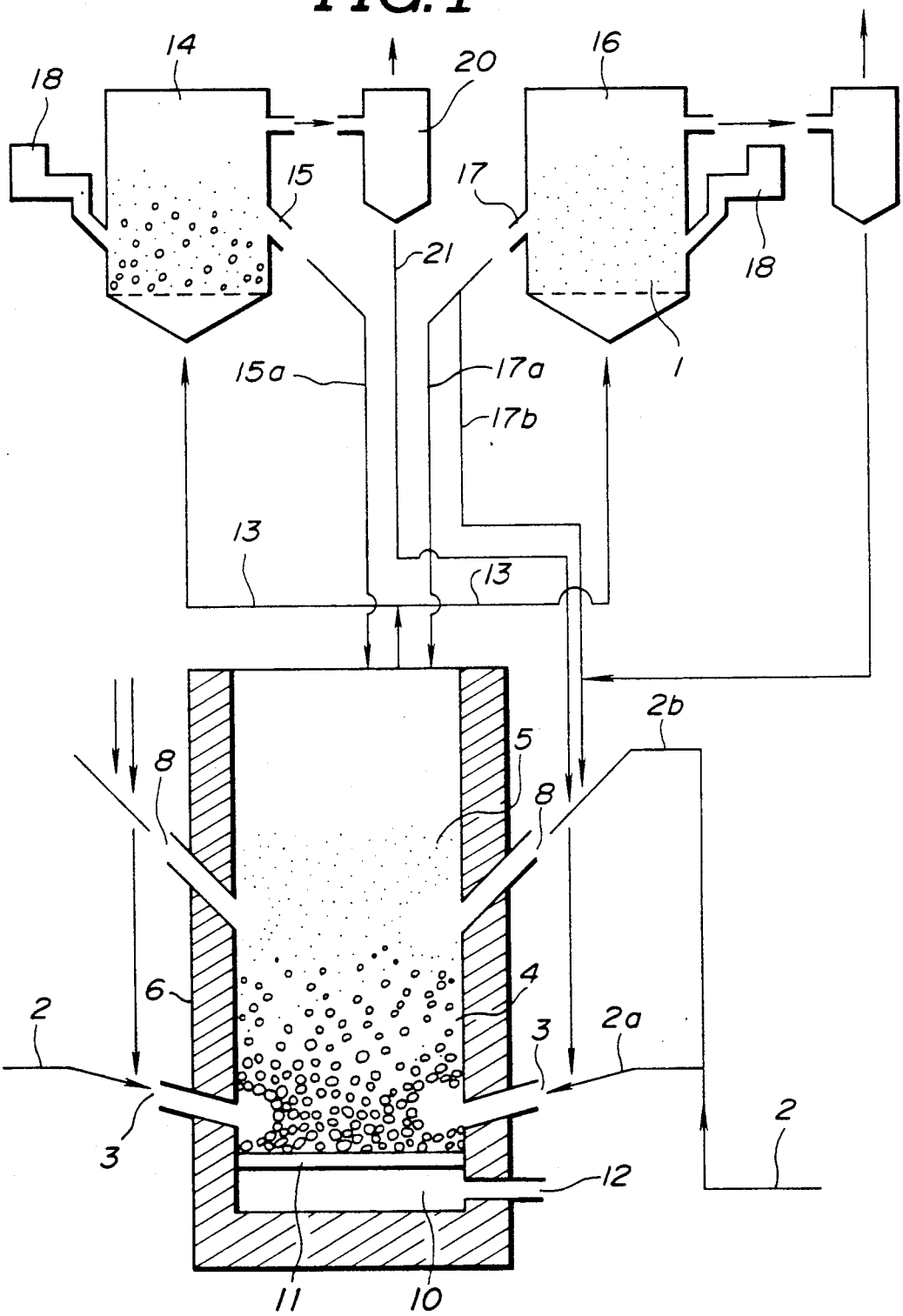
FIG. 1 is a diagramatical illustration of the first embodiment of a shaft furnace arrangement which implements the preferred embodiment of method for producing molten metal from powder state ore through a smelting process.

Referring now to the drawings, particularly to FIG. 1, the first embodiment of a shaft furnace arrangement is particularly designed for smelting and/or reducing powder state ore for obtaining molten metal. A shaft furnace 6 is employed for implementing the preferred process of smelting operation. A reducing material pretreatment furnace 14 is also provided for performing pre-treatment of solid state carbon containing reducing material, such as coke. In the pre-treatment furnace 14, pre-heating of the reducing material may be preformed. The pre-treatment for the reducing material to be performed in the pre-treatment furnace also includes classifying or sizing of the reducing material. Reducing material having a grain size larger than or equal to the gas flow velocity corresponding to the grain size, is selected to be transferred through a reducing material outlet 15 of the pre-treatment furnace 14 and a reducing material transferring passage way 15*a*, to be charged into the shaft furnace as a burden of the furnace. The reducing material charged in the shaft furnace 6 forms a fluidized bed 5 at the upper section 5 and solid state reducing material filled section 4, which fluidized bed is formed above the solid state reducing material filled section.

The gas flow velocity corresponding to the grain size of the solid state reducing material may be arithmetically derived on the basis of the temperature, pressure and gas flow amount, gas flow velocity in the furnace, apprarent density of the reducing material, density of gas and viscosity coefficient, utilizing Allen's formula or Newton's formula. In the shown embodiment, the grain size of the solid state reducing material to be charged to the furnace 6 is selected to be larger than or equal to twice the gas flow velocity corresponding to the grain size.

The shaft furnace arrangement further includes an ore pre-treatment furnace 16 which performs pre-treatment for powder state ore. In the pre-treatment for powder state ore in the ore pre-treatment furnace 16, the pre-fluidization and pre-reduction of the ore is performed. The pre-treated ore is transferred through the outlet 17 and an ore passage way 17*a* as a constitutent of the burden to be charged through the top of furnace. Part of the pre-treated ore is derivered through an ore passage way 17*b* to be introduced into the fluidized bed 5 in the furnace.

The shaft furnace 6 is provided with two vertically offset groups of tuyeres 3 and 8. One group of tuyeres 3 are located at a lower elevation than others 8 and directed to the solid state reducing material filled section 4. On the other hand, the upper group of tuyeres 8 are directed toward the the fluidized bed 5. The tuyeres 3 located at the lower elevation will be hereafter referred to as "lower tuyeres" and the other tuyeres 8 located at an upper elevation will be hereafter referred to as "upper tuyeres".

The lower and upper tuyeres 3 and 8 are respectively connected to oxygen containing gas source 2 to introduce therefrom oxygen containing gas through gas passage ways 2*a* and 2*b*. The oxygen containing gas introduced into the furnace through the upper tuyeres 8 serves for fluidization of the reduction material to form the fluidized bed. On the other hand, the reduction as introduced into the furnace via the lower tuyeres 3 serves for reducing the ore travelling through the solid state reducing material filled section 4.

The ore passage way 17*a* is connected to the gas passage ways 2*b*. Therefore, the powder state ore fed through the ore passage way 17*a* is introduced into the passage ways 2*b* and is blown into the fluidized bed 5 in the furnace 6 via the upper tuyeres 8. The ore introduced into the fluidized bed 5 is fluidized to drop through the solid state reducing material filled section 5. During its drop through the solid state reducing material filled section 4, the ore is molten and reduced. Furthermore, during drop, molten metal 10 and slag 11 are separated to be separately collected in the bottom of the furnace. The molten metal 10 collected in the bottom of the shaft furnace 6 is tapped via tapping notch 12.

On the other hand, the reducing material having a grain size smaller than the gas flow velocity corresponding grain size, is collected by a collector 20 and fed through a reducing dust passage way 21. The passage way 21 is connected to the gas passage ways 2*a* and 2*b*. The ratio of the reducing material to be introduced into the gas passage way 2*a* and 2*b* may be adjusted in view of the grain distribution of the reducing material to be charged through the reducing material transferring passage way 15*a* so that the temperature in the solid state reducing material filled section 4 can be controlled to be adapted for the molten metal to be produced.

During the smelting operation, exhaust gas rises through the solid state reducing material filled section 4 and the fluidized bed 5 is collected and circulated into the reducing material pre-treatment furnace 14 and the ore pre-treatment furnace 16. The exhaust gas introduced into the reducing material pre-treatment furnace is utilized as distillation gas for distilling the reducing material in the pre-treatment.

In order to confirm the performance of the aforementioned first embodiment of the smelting process, experiments were performed. In the experimentation, a shaft furnace of 1.2m diameter furnace was used.

EXAMPLE 1

| | | |
|---|---|---|
| 1) Powder State Ore | | |
| Brand: MBR-PB | | |
| Grain Size: 150 mesh or below; | | |
| 2) Carbon Containing Reducing Material | | |
| Kind: South African Coal | | |
| Grain Size: Grain Distribution | 20–10 mm | 34% |
| | 10–5 mm | 27% |
| | 5–1 mm | 24% |
| | −1 mm | 15% |

In the experimentation of the example 1, the gas flow velocity corresponding grain size as derived was 0.5 mm. The reducing material of 20 to 1 mm grain size is charged through the top of the shaft furnace. The reducing material having a grain size smaller than 1 mm was introduced into the furnace through the upper and lower tuyeres 3 and 8. Overall charge amount of the reducing material was 1040 kg/h. To this, the amount of the reducing material to be introduced into the fluidized bed through the upper tuyeres 8 was 95 kg/h (9.1% of overall reducing material amount). The amount of the reducing material to be introduced into the solid state reducing material filled section 4 was 61 kg/h (5.9% of the overall amount of the reducing material). From the condition set forth above. 11.8 tons of pig iron could be produced in per day.

EXAMPLE 2

| | | |
|---|---|---|
| 1) Powder State Ore | | |
| Brand: MBR-PB | | |
| Grain Size: 150 mesh or below; | | |
| 2) Carbon Containing Reducing Material | | |
| Kind: South African Coal | | |
| Grain Size: Grain Distribution | 20–10 mm | 28% |
| | 10–5 mm | 28% |
| | 5–1 mm | 25% |
| | −1 mm | 19% |

In example 2, the gas flow velocity corresponding grain size as derived was 0.5 mm. The reducing material of 20 to 1 mm grain size was charged through the top of the shaft furnace.

The reducing material having a grain size smaller than 1 mm was introduced into the furnace through the upper and lower tuyeres 3 and 8. Overall charge amount of the reducing material was 997 kg/h. To this, the amount of the reducing material to be introduced into the fluidized bed through the upper tuyeres 8 was 78 kg/h (7.8% of overall reducing material amount). The amount of the reducing material to be introduced into the solid state reducing material to be introduced into the solid state reducing material filled section 4 was 111 kg/h (11.1% of the overall amount of the reducing material). From the condition set forth above, 11.2 tons of pig iron could be produced in per day.

As will be seen herefrom, since the grain size of the reducing material charged through the top of the furnace was smaller than that used in the former example 1, the small grain size reducing material to be introduced into the solid state reducing material filled section 4 was increased in comparision with that in the example 1.

In either example, the small grain size reducing material introduced into the fluidized bed 5 becomes a high temperature particle. Since the powder state ore is introduced into the fluidized bed 5 together with the reducing material, the molten ore tends to adhere on the surface of the small grain size reducing material. This makes reduction of the ore more efficient.

In another embodiment of the smelting process of the molten metal from the powder state ore, operation is performed by charging a reducing material of a grain size greater than or equal to 3 mm diameter. The reducing material of the grain size smaller than 3 mm diameter is discharged through the upper and the lower tuyeres 8 and 3. In order to separate the large grain size reducing material which has a grain size greater than or equal to 3 mm diameter and small grain size reducing material which has a grain size smaller than 3 mm diameter, classification of the reducing material may be performed in the reducing material pre-treatment furnace and associated classification device.

In order to implement the another embodiment of the smelting method, an experiment was performed utilizing a shaft-type reduction furnace which had 1.2m of internal diameter, 5m of height and about 10 tons of production capacity of pig iron per day, which, in turn, has a production capacity for about 5 tons of ferrochromium per day. The large grain size reducing material was charged through the top of the furnace. The small grain size reducing material was then blown into the fluidized bed 5 and the solid state reducing material filled section 4 via the upper and lower tuyeres 8 and 3. Distribution rate of the small grain size reducing material was adjusted depending upon the temperature of the molten metal to produce. Utilizing the aforementioned facility a, smelting operation was performed for producing pig iron and ferrochromium from iron ore from Australia and chromite from South Africa, the compositions of which are shown in the appended table 1. In order to compare with the inventive examples 3 and 4, comparative experiments were also performed, the results of which are shown as comparative examples 1 and 2 in the appended table 2. In the comparative experiments, the overall amount of reducing material was charged through the top of the furnace regardless of the grain size. On the other hand, in the inventive examples 3 and 4, the distribution rate of the small grain size reducing material was adjusted so that the rate may be changed in a range of 0% to 100% depending upon the tapping temperature. The results of the experimentation are shown in the appended table 2.

As will be seen from the table 2, it should be appreciated that, by using large grain size reducing material as burden to be charged through the top of furnace for forming the fluidized bed and the solid state reducing material filled section in the furnace and blowing the small grain size reducing material through the tuyeres at a controlled distribution rate, the total consumption of the reducing material could be decreased. In addition, the tapping temperature and Si concentration of the molten metal can be maintained at a narrower variation range in relation to the desired tapping temperature and desired Si concentration, in comparision with the variation range of the comparative examples.

Figure 2:
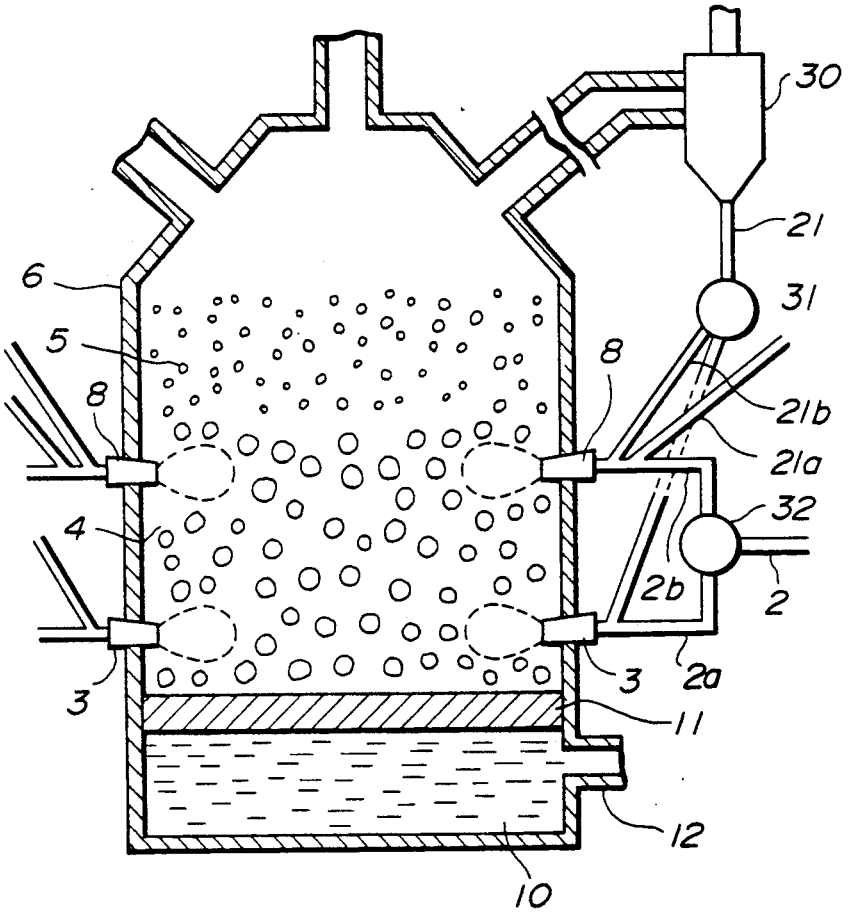
FIG. 2 is a diagramatical illustration of the second embodiment of a shaft furnace arrangement for implementing the preferred smelting process for producing molten metal from powder state ore.

FIG. 2 shows the a second embodiment of the shaft furnace arrangement according to the invention, which implements the preferred smelting process for producing molten metal from powder state ore. In the shown second embodiment, the elements of the same construction and same functions to that of the foregoing first embodiment are represented by the same reference numerals to the foregoing first embodiment. For the elements represented by the common reference numerals to the foregoing FIG. 1, the detailed description will be neglected in order to avoid redundacy of the recitation.

The shaft furnace arrangement of FIG. 2 is characterized by a dust collecting unit 30. The dust collecting unit 30 collects dust of reducing material which flows away from the charged reducing material layer with the exhaust gas. The dust collecting unit 30 recovers the reducing material dust and recirculates to the passage 21. On the other hand, the dust collecting unit 30 may feed the high temperature exhaust gas to the reducing material pre-treatment furnace (not shown in FIG. 2) and the ore pre-treatment furnace (not shown in FIG. 2) for utilizing the heat of the exhaust gas in pre-treatment.

In the shown embodiment, the passage way 21 is branched to have two branches 21*a* and 21*b* at a distribution unit 31. The branch 21*a* is connected to the gas flow passage way 2*a* and the branch 21*b* is connected to the gas flow passage way 2*b*. A gas distribution unit 32 is disposed between the gas flow passage ways 2*a* and 2*b* for adjusting distribution of the oxygen containing gas to flow therethrough.

Though it is not clearly shown in FIG. 2, it may be possible to connect the dust collecting unit to the reducing material pre-treatment furnace to receive therefrom the small grain size reducing material which has a grain size smaller than the gas flow velocity corresponding grain size.

In the shown construction, the amount of the small grain size reducing material to be distributed to the branches 21*a* and 21*b* is so controlled as to vary so as to control consumption of the charged large grain size reducing materials. Namely, when the large grain size reducing material is reduced to cause lowering of the molten metal temperature to lower the quality of the produced molten metal, the amount to be derived to the solid state reducing material filled section 4 via the branch 21*a* and the lower tuyeres 3, is increased. By increasing the small grain size reducing material in the solid state reducing material filled section 4 combustion occurs both in the small and large grain size reducing materials so as to reduce the required amount of the large grain size reducing material for maintaining the temperature of the solid state reducing material filled section 4 at the desired temperature. This expands the period required to retain the large grain size reducing material in the reducing material filled section 4. This make it possible to increase the temperature in the reducing material filled section 4. This increases the temperature of the molten metal passing through the reducing material filled section and thus can stably maintain the composition of the molten metal. On the other hand, when an excessive volume of large grain size reducing material is in the reducing material filled section, the temperature of the molten metal tends to be excessively high. In this case, the small grain size reducing material to be introduced into the reducing material filled section 4 is reduced. By this, consumption of the large grain size reducing material is increased to lower the temperature in the reducing material filled section and lower the temperature of the molten metal.

In order to check the performance of the shown second embodiment of the shaft furnace and the preferred smelting process, an experiment was performed by utilizing a shaft type reduction furnace 6 which has a capacity for producing about 10 tons of pig iron per day and about 5 tons of ferrochromium. In the experimentation, iron ore from Australia and chromite from South Africa, composition of which are shown in the appended table 1, were used for producing pig iron and ferrochromium.

The amount of the small grain size reducing material to be distributed to the fluidized bed 5 and the reducing material filled section 4 were adjusted depending upon the molten metal temperature and Si concentration. The appended table 3 shows compositions of the dust used in smelting operations for the aforementioned ores. In order to compare with the results obtained from the preferred process, comparative experiments were performed. The results of the experimentations of the preferred process and the comparative examples are shown in the appended table 4.

In the comparative examples 3 and 5, smelting operations are performed without blowing into the small grain size reducing material through the tuyeres. In the comparative example 4, the distribution rate of the small grain size reducing material as fixed at 1:1 to blow into the fluidized base 5 and the reducing material filled section 4.

In example 5, distribution of amount of the small grain size reducing material to be blown through the upper tuyeres 8 and the lower tuyeres $ are adjusted in view of the tapping temperature and Si concentration. In this case, the adjustment range of the distribution of the amount of the small grain size reducing material was 20 to 80% in both of the upper and lower tuyeres. On the other hand, in the examples 6 and 7, the distribution of the amount of the small grain size reducing material to be blown through the upper and lower tuyeres are adjusted in a range of 0 to 100% in view of the tapping temperature.

From the experimentation set forth above, it was observed that the actual tapping temperatures and Si concentrations in comparative examples 3 and 4 did not match the desired values and fluctuated in a wide range. On the other hand, in examples 5 and 6, the tapping temperature matched the desired value and fluctuated in a small range close to the desired value. In addition, in examples 7 and 6, the Si concentrations were maintained at a substantially narrow range across the desired value. In case of the comparative example 5, both the tapping temperature and Si concentration fluctuated in a substantial range across the desired value. To contrary, in the example 7, both the tapping temperature and Si concentration could be maintained in substantially narrow fluctuation range across the desired value.

The results of expermentation are shown in the appended table 4. As will be seen from the table 4, by adjusting the small grain size reducing material distribution at the upper and lower tuyeres, the tapping temperature and Si concentration can be stably maintained at approximately the desired values. Therefore, consumption of the reducing material can be economized.

Figure 3:
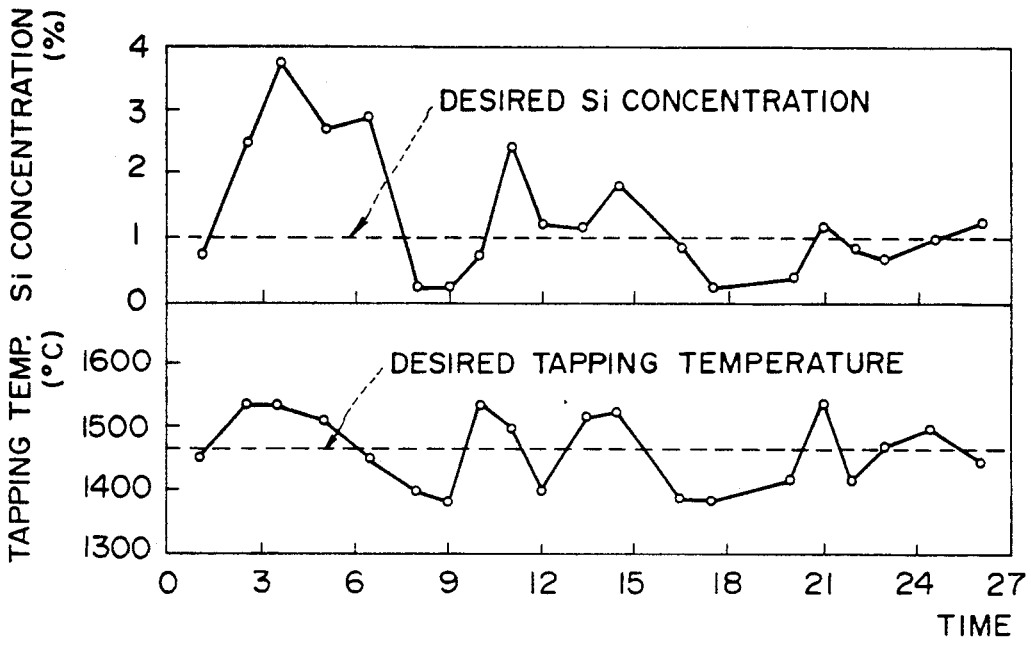
FIG. 3 and 4 are graphs showing variation of Si content and tapping temperature through an operation period in the smelting process of the second embodiment and a comparative example.
Figure 4:
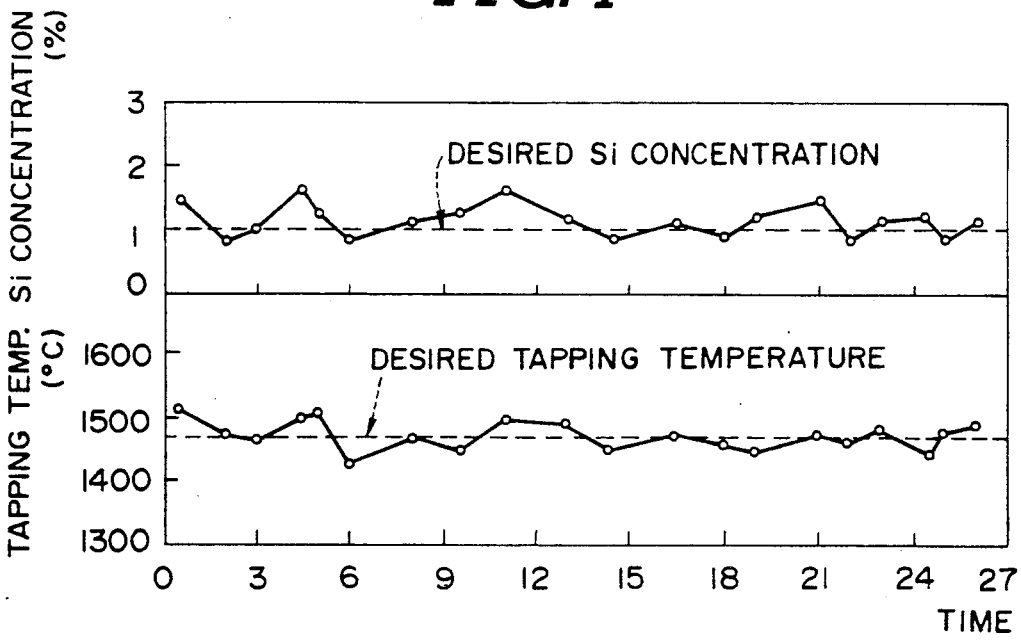

FIGS. 3 and 4 show variation of tapping temperature and Si concentration in comparative example 5 and the example 6. In the example 6, the distribution of the amount of the small grain size of the reducing material was derived according to the following formulas:

when $a > b + 50$ $\alpha = 0$ when $b + 50 > a > b - 50$ $\alpha = 0.5 - 0.01 \times (a - b)$ when $a < b - 50$ $\alpha = 1.0$ where a: tapping temperature;

b: desired tapping temperature $\alpha$: distribution rate of the small grain size reducing material for the lower tuyere relative to the total amount of the small grain size reducing material to be discharged into the furnace.

As will be seen from FIGS. 3 and 4, by adjusting the small grain size reducing material distribution at the upper and lower tuyeres the tapping temperature and Si concentration can be maintained approximately at the desired values.

As will be appreciated herefrom, in the smelting process according to the present invention, a substantially constant and high quality of molten metal can be produced with high efficiency of reducing material, such as coal or coke, by discharging a controlled distribution of the small grain size reducing material which tends to be blown away if charged from the top of the furnace as a burden. Therefore, the present invention fulfills all of the objects and advantages sought therefor.

While the present invention has been disclosed in terms of preferred embodiments in order to facilitate a better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

TABLE 1

| | T.Fe | T.Cr | $SiO_2$ | $Al_2O_3$ | S | Ave. Grain Size (mm) |
|---|---|---|---|---|---|---|
| IRON ORE (Australia) | 66.1 | tr | 3.2 | 0.7 | 0.003 | 1.23 |
| Chromite (South Africa) | 19.2 | 30.8 | 3.1 | 14.5 | 0.001 | 0.74 |

TABLE 2

| MOLTEN METAL TO BE PRODUCED | COM. 1 | EXAM. 3 | COM. 2 | EXAM. 4 |
|---|---|---|---|---|
| | PIG IRON | | FERROCHROMIUM | |
| REDUCING MATERIAL DUST DISTRIBUTION RATE (%) (UPPER TUYERE) | — | 0~100 | — | 0~100 |
| REDUCING MATERIAL DUST DISTRIBUTION RATE (%) (LOWER TUYERE) | — | 0~100 | — | 0~100 |
| CONSUMED COAL AMOUNT | 995 | 912 | 1884 | 1785 |
| DESIRED TAPPING TEMP. | 1470 | 1470 | 1580 | 1580 |
| ACTUAL TAPPING TEM. | 1357~1536 | 1431~1511 | 1507~1632 | 1538~1607 |
| DESIRED Si CONCENTRATION | 1.0 | 1.0 | 2.5 | 2.5 |
| ACTUAL Si CONCENTRATION | 0.31~4.3 | 0.87~1.8 | 1.5~5.1 | 1.5~3.0 |

TABLE 3

| C | T.Fe | CaO | $SiO_2$ | $Al_2O_3$ | MgO |
|---|---|---|---|---|---|
| 53.3 | 6.1 | 10.1 | 17.4 | 7.5 | 3.7 |

TABLE 4

| MOLTEN METAL TO BE PRODUCED | COM. 3 | COM. 4 | EXAM. 5 | EXAM. 6 | COM. 5 | EXAM. 7 |
|---|---|---|---|---|---|---|
| | PIG IRON | | | | FERROCHROMIUM | |
| REDUCING MATERIAL DUST DISTRIBUTION RATE (%) (UPPER) | | 50 | 20~80 | 0~100 | | 0~100 |
| REDUCING MATERIAL DUST DISTRIBUTION RATE (%) (LOWER) | | 50 | 20~80 | 0~100 | | 0~100 |
| COAL CONSUMPTION (kg/t-metal) | 987 | 930 | 922 | 903 | 1875 | 1780 |
| DESIRED TAPPING TEMP. (°C.) | 1470 | 1470 | 1470 | 1470 | 1580 | 1580 |
| ACTUAL TAPPING TEMP. (°C.) | 138~1540 | 1390~1532 | 1417~1511 | 1423~1507 | 1509~1624 | 1543~1614 |
| DESIRED Si CONCENTRATION (%) | 1.0 | 1.0 | 1.0 | 1.0 | 2.5 | 2.5 |
| ACTUAL Si CONCENTRATION (%) | 0.27~3.8 | 0.27~3.2 | 0.53~2.2 | 0.84~1.7 | 1.7~4.8 | 1.9~3.1 |

What is claimed is:

1. A method for producing molten metal from powder state ore in a fluidized bed formed in a furnace chamber with a gas flow velocity therein and with the use of particles having selected grain sizes in relation to their borderline grain sizes defined as sizes which are on the borderline between being blown away and not being blown away under the existing conditions of said gas flow velocity, said method comprising the steps of:

providing a furnace chamber filled with a carbon containing reducing material as a burden, forming in said chamber a fluidized bed and a solid burden layer below said fluidized bed, said burden having a grain size greater than its borderline grain size in relation to said gas flow velocity;

supplying a mixture of an oxygen containing gas, a powder state ore and a reducing material dust which has a grain size smaller than said borderline grain size to a first tuyere connected to said fluidized bed; and supplying a mixture of said oxygen containing gas and said reducing material dust which has a grain size smaller than said borderline grain size through a second tuyere connected to said solid burden layer.

2. A method as set forth in claim 1, which further comprises the step of distributing said reducing material dust for said first and second tuyeres at respectively controlled distribution rates.

3. A method as set forth in claim 2, wherein in the step of distribution of said reducing material dust at a controlled distribution rate, said distribution rate of said reducing material dust for said first and second tuyeres is determined depending upon a given tapping temperature of the molten metal.

4. A method as set forth in claim 2, wherein said step of distributing reducing material dust at the controlled distribution rate is determined depending upon a given desired Si concentration of the molten metal to be produced.

5. A method as set forth in claim 3, wherein said step of distributing reducing material dust at the controlled distribution rate is determined depending upon a given desired Si concentration of the molten metal to be produced.

6. A method as set forth in claim 3, wherein said distribution rate for said second tuyere is increased when the molten metal temperature is lower than said desired tapping temperature and decreased when the molten metal temperature is higher than said desired tapping temperature.

7. A method as set forth in claim 2, wherein said borderline grain size is determined relative to a minimum grain size of said burden which is not blown away from the furnace with an exhaust gas.

8. A method as set forth in claim 7, wherein said borderline grain size is set at a value greater than said minimum grain size.

9. A method as set forth in claim 3, wherein said borderline grain size is determined relative to a minimum grain size of said burden which is not blown away from the furnace with an exhaust gas.

10. A method as set forth in claim 9, wherein said borderline grain size is set at a value greater than said minimum grain size.

11. A method as set forth in claim 7, wherein said borderline grain size of said burden is 3 mm diameter.

12. A method as set forth in claim 9, wherein said borderline grain size of said burden is 3 mm diameter.

13. A method as set forth in claim 2, which further comprises the step of collecting the reducing material dust contained in the exhaust gas of the furnace for recirculating the collected dust through said first and second tuyeres.

14. A method as set forth in claim 13, wherein in the step of distribution of said reducing material dust at a controlled distribution rate, said distribution rates of said reducing material dust for said first and second tuyeres are determined depending upon a given tapping temperature of the molten metal.

15. A method as set forth in claim 14, wherein said distribution rate for said second tuyere is increased when the molten metal temperature is lower than said desired tapping temperature and decreased when the molten metal temperature is higher than said desired tapping temperature.

* * * * *